United States Patent [19]

Leach et al.

[11] 4,339,742

[45] Jul. 13, 1982

[54] HIGH VOLTAGE FUSE HAVING MOUNTED GAS EVOLVING MEMBERS AND METHOD OF FORMING SUCH

[75] Inventors: John G. Leach, Hickory, N.C.; Robert E. Koch, Pittsfield, Mass.

[73] Assignee: General Electric Company, Philadelphia, Pa.

[21] Appl. No.: 270,561

[22] Filed: Jun. 4, 1981

[51] Int. Cl.[3] ..... N01H 85/44

[52] U.S. Cl. ..... 337/279; 337/296

[58] Field of Search ..... 337/158, 159, 160, 161, 337/273, 274, 279, 296

[56] References Cited

U.S. PATENT DOCUMENTS

| | | | |
|---|---|---|---|
| 3,743,994 | 7/1973 | Kozacka | 337/295 |
| 3,864,655 | 2/1975 | Kozacka | 337/296 |
| 4,054,858 | 10/1977 | Jacobs | 337/296 |
| 4,179,677 | 12/1979 | Kozacka et al. | 337/161 |

*Primary Examiner*—George Harris

*Attorney, Agent, or Firm*—William Freedman; John P. McMahon

[57] ABSTRACT

A high voltage fuse having mounted gas evolving members and method of forming such a fuse are disclosed. The high voltage fuse comprises, in part, a plurality of block shaped gas evolving members attached to a plurality of fuse elements, which, in turn, are wound about a supporting core. The high voltage fuse also has an electrically insulating casing in which is mounted the core having the wound fuse elements and the attached blocks of gas evolving members. The fuse casing is filled with a pulverulent arc quenching filler material. The block shaped gas evolving members have a narrow slit which allows the gas evolving members to be easily slipped over the fuse element so as to cover part or all of a transverse portion of the fuse. The gas evolving members are positioned over the fuse element at locations along the core so that the block type gas evolving members are arranged between adjacent portions of the ribs of the core. The block type gas evolving members are further positioned in desired locations by disposing the gas evolving members between the adjacent turns of the fusible elements. Positioning the gas evolving material blocks at their desired locations provides stationary boundaries and limits the movement of the gas evolving material during the filling of the fuse casing by the pulverulent arc quenching filler material.

7 Claims, 5 Drawing Figures

HIGH VOLTAGE FUSE HAVING MOUNTED GAS EVOLVING MEMBERS AND METHOD OF FORMING SUCH

BACKGROUND OF THE INVENTION

This invention relates to a high voltage current limiting fuse, and more particularly, to fuse elements of the high voltage fuse having blocks of gas evolving members slipped over the fuse elements at desired locations within the housing of the high voltage fuse.

High voltage current limiting fuses having gas evolving members adapted to evolve a gas in the presence of an arc to aid in arc extinction within a fuse housing are well known. One such high voltage current limiting fuse is described in U.S. Pat. No. 3,766,509, issued to F. L. Cameron, Oct. 16, 1973. In U.S. Pat. No. 3,766,509 the gas evolving members are isostatically compressed directly onto an associated fusible element. The positions of the isostatically compressed gas evolving members on the fuse element are selected with regard to the positions the gas evolving material attains when the fuse element is arranged within the fuse housing. This selection is somewhat restricted when a fuse element is to be arranged within the fuse housing by wrapping the fuse element about a supporting core. Furthermore, as a wrapping angle between adjacent turns desired for the fuse element is altered for various desired fuse configurations, the positions of the affixed gas-evolving members need to be altered to conform to the positions the gas evolving members are to attain when positioned within the desired fuse configuration. It is considered desirable to allow the gas evolving members to be placed onto the fuse element after the fuse element is arranged on the supporting core so that various desired fuse configurations may be more easily attained.

Accordingly, it is an object of the present invention to provide gas evolving members which are so constructed as to allow the members to be placed onto the fusible element after the fusible element has been wound onto the core.

It is another object of the present invention to provide gas evolving members which are so constructed as to allow the members to be placed onto the fusible element such that the members remain within fixed boundaries within the fuse housing during the subsequent handling and assembly of the core assembly into the fuse housing.

It is a further object of the present invention to provide a method for mounting the gas evolving members onto the fuse element.

These and other objects of the present invention will become apparent to those skilled in the art upon consideration of the following description of the invention.

SUMMARY OF THE INVENTION

The present invention is directed to providing a high voltage fuse having gas evolving members positioned onto a fuse element.

In accordance with one preferred embodiment of the invention, the high voltage fuse comprises a generally tubular electrically insulating casing, terminal means disposed adjacent to each of the opposite ends of the casing, and a pulverulent arc quenching filler material within the casing. The high voltage fuse further comprises a core of cross or star-shaped transverse cross-section comprising a plurality of fins. The core axially and longitudinally extends between the opposite ends of the casing. The high voltage fuse still further comprises one or more ribbon-type fuse elements having a predetermined width and thickness and wound about the core. The high voltage fuse further comprises a plurality of gas evolving members adapted to evolve a gas in the presence of an arc which aids in the extinction of the arc within the casing. The gas evolving members are mounted over a portion of at least one of the fuse elements. Each of the plurality of gas evolving members has a narrow slit. The slit has dimensions relative to the dimensions of the one or more fuse elements to allow the gas evolving member to be slipped over the edge of the ribbon-type fuse element and cover all or part of the width of a portion of the fuse element. The plurality of gas evolving members are mounted onto one or more of the fuse elements at predetermined locations along the core so as to arrange each of the plurality of gas evolving members between the fins of the core.

The features of the invention believed to be novel are set forth with particularlity in the appended claims. The invention, itself, however, both as to its organization and method of operation, together with further objects and advantages thereof, may best be understood by reference to the following description taken in conjunction with the accompanying drawings.

DETAILED DESCRIPTION OF THE PREFERRED EMBODIMENT

Figure 1:
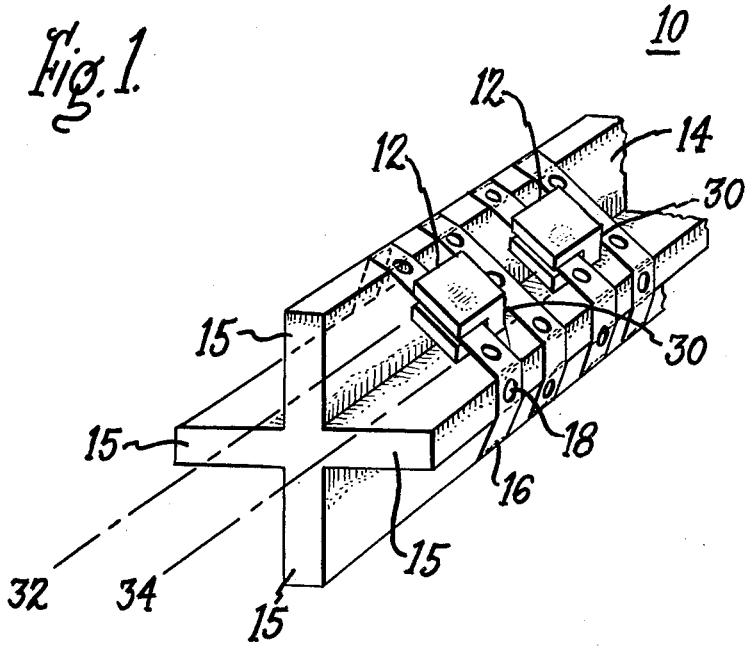
FIG. 1 is a perspective view showing a portion of the core, and a portion of one of the fuse elements having gas evolving members arranged in accordance with the present invention.

FIG. 1 is a perspective view 10 of a portion of a high voltage current limiting fuse of the present invention. FIG. 1 shows a supporting means or core 14 about which is wound a fuse element 16 having perforations 18. It is to be understood that the core 14 and fuse element 16 are typically located within a tubular insulating housing having electrical terminals at its opposite ends and that the fuse element 16 provides an electric circuit between these terminals. Such housing and terminals are not shown in FIG. 1, but reference may be made to U.S. Pat. No. 3,294,936 issued to H. W. Mikulecky for such a showing. This latter patent is incorporated by reference into the present application.

While we have shown a single fuse element 16 wrapped about the core 14, it is to be understood that the invention comprehends a fuse construction in which a plurality of fuse elements 16, electrically connected in parallel, are wrapped about the core 14 and interconnect the terminals of the fuse. Core 14 is typically formed of an electrically insulating high temperature withstand material such as a vitrified ceramic. Core 14 is further typically formed to have a cross or star type transverse cross-section and includes generally radially-projecting limbs or fins 15 that extend longitudinally and axially of the fuse casing.

The fuse element 16 has a ribbon type shape and is comprised of an electrically conductive material such as silver. The fuse element 16 has perforations 18 formed by cutouts in its central portion 16 so as to provide a plurality of reduced cross sections, which, as is well known, facilitate the melting or rupturing of the fusible element under fault current conditions.

FIG. 1 shows the fuse element 16 as having mounted onto it gas evolving members 12. The gas evolving members 12 are adapted to evolve a gas in the presence of an arc. The evolved gas aids in the extinction of the arc conditions within the fuse housing which may occur when the fuse element or elements 16 are subjected to overload current conditions. The specific composition of the material of the gas evolving members is not a part of the present invention, and any suitable gas evolving material may be used for member 12. One material that is suitable for this purpose is a material comprised of a water-insoluable binder such as polyester resin and an anti-tracking material such as aluminum hydrate. A specific example is disclosed in U.S. Pat. No. 3,437,971, issued Apr. 8, 1969 to H. W. Mikulecky. Another example of a suitable material is a clay material comprised of kaolin and boron phosphate.

The gas evolving members 12 of this invention are adapted to be easily mounted onto the fuse element 16 by slipping each of the gas evolving members over the fuse element 16. The easy mounting of the gas evolving members 12 onto the fuse element 16 allows the members 12 to be easily positioned over a wound fuse element 16, previously arranged on the core 14, so as to provide stationary boundaries which limit the movement of the gas evolving members 12 before and during the filling of the fuse casing with a pulverulent arc quenching material. The mounted gas evolving member 12 on the fuse element 16 is best seen in FIGS. 2, 3 and 4, whereas the stationary boundaries for the gas evolving members 12 is best seen in FIGS. 1 and 5.

Figure 2:
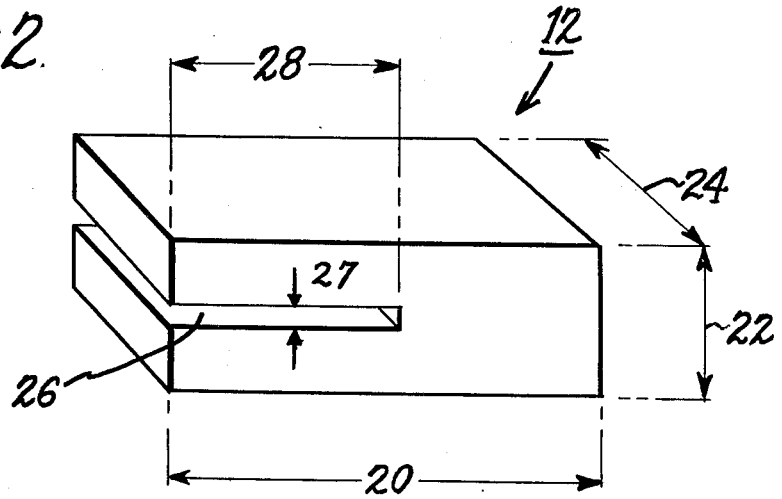
FIG. 2 shows a perspective view of a gas evolving member.

FIG. 2 shows a gas evolving member 12 as having a block type shape and a narrow slit 26, which spans the width 24 of the gas evolving member 12. The dimensions of the gas evolving member 12 and its slit 26 are selectable to adapt the mounting of the gas evolving member to various types of fuse elements 16 and to various desired spacing between adjacent turns of the wrapped fuse element 16. For example, for a typical fuse element 16 having a thickness of 0.10 mm and a width of 3.0 mm, the gas evolving member 12 is selected to have a width 24 of 10.0 mm, and a slit 26 having a width 27 of 0.50 mm with the depth 28 of the slit 26 being 3.50 mm. Still further, for a desired spacing between adjacent turns of fuse element 16 of 7.0 mm, the length 20 of gas evolving member 12 is selected to have a dimension of 10.0 mm. For the typical previously given dimensions of gas evolving member 12, the height 22 is selected to have a dimension of 6.0 mm. The dimensions of each gas evolving member 12, in particular slit 26, are chosen so as to allow the gas evolving member 12 to be easily slipped over the edge of the ribbon-type fuse element and moved transversely of the fuse element to cover all or part of the width of a portion of the fuse element 16. The internal interrelated positions of the gas evolving member 12 and the fuse element 16 are best seen in FIGS. 3 and 4.

Figure 3:
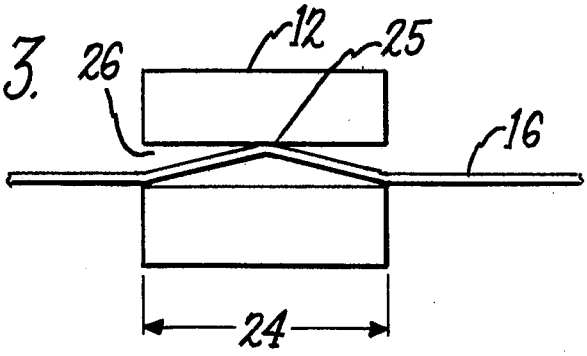
FIG. 3 shows a side view of an arrangement of the fuse element and the gas evolving member.

FIG. 3 is a front view of the gas evolving member 12 having positioned within its slit 26 the fuse element 16. The fuse element 16 may have a crimp arrangement 25 placed into its central portion so as to raise and abut the central portion of the fuse element 16 against the central portion of the slit 26. The crimp arrangement 25 reduces the relative movement between the fuse element 16 and gas evolving members 12 that may occur during assembly of the fuse.

Figure 4:
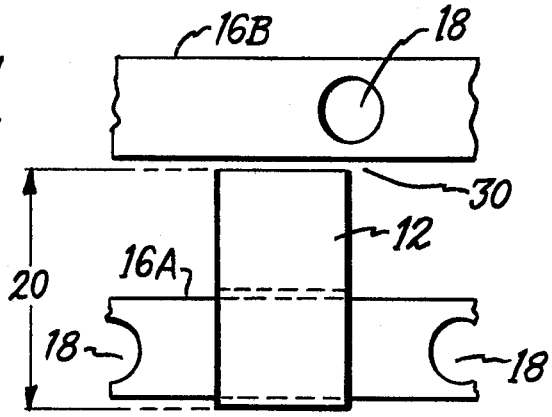
FIG. 4 shows the position of the gas evolving member on the fusible element and relative to the adjacent fusible element.
Figure 5:
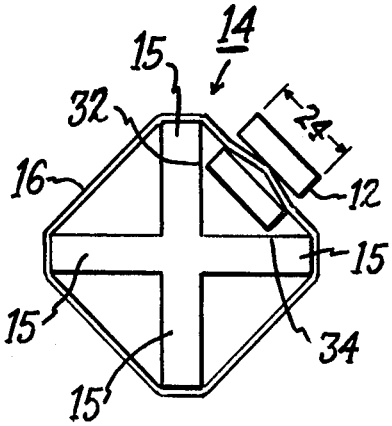
FIG. 5 is a view taken along a plane extending transversely of the core and showing the arrangement of the gas evolving member relative to the fins of the supporting core.

FIG. 4 shows the block shaped gas evolving member 12 positioned between adjacent turns of portions 16A and 16B of fuse element 16. The gas evolving member 12 is shown as being mounted onto a first turn of a portion 16A of fuse element 16 and separated from a second or adjacent turn of portion 16B by a spacing 30. If desired the spacing 30 may be reduced to be substantially zero by appropriate selection of the length 20 of the gas evolving member 12 or by appropriate selection of the spacing desired between adjacent turns of the fuse element 16. These appropriate selections for spacing 30 allow the gas evolving member 12 mounted on the first portion 16A to abut against the second portion 16B. Spacing 30 forms part of the boundary limiting the movement of the gas evolving members 12. Further limiting boundaries for gas evolving members 12 are shown in FIG. 5.

FIG. 5 is a view taken along a plane extending transversely of the core and showing the arrangement of the gas evolving member 12, the fuse element 16, and the core 14. FIG. 5 further shows the gas evolving member 12 positioned between opposite portions 32 and 34 of the fins 15 of the core 14. As shown in FIG. 5 the portions 32 and 34 provide a stationary means for limiting the movement of the gas evolving member 12. The positioning of the gas evolving member relative to portions 32 and 34 is sufficient to maintain the gas evolving members 12 within fixed boundaries within the fuse housing during subsequent handling and assembly of the core into the fuse housing. The movement of gas evolving member 12 relative to the portions 32 and 34 may be further restricted by appropriate selection of the width 24 of the gas evolving member 12. The width 24 may be selected so as to allow the gas evolving members 12 to abut against the portions 32 and 34 of the core 14. The limitation of movement of the gas evolving members 12 provided by the portions 32 and 34 of core 14 and also if desired by the adjacent turns of the fuse element 16 is best seen in FIG. 1.

FIG. 1 shows two gas evolving members 12 positioned between the portions 32 and 34 of the ribs 15 of cord 14 and also positioned between and abutting against, as shown by reference number 30, adjacent turns of fuse element 16. From FIG. 1 and from the previously given descriptions of the crimp arrangement 25 shown in FIG. 3, the separation 30 shown in FIG. 4, and the position of the gas evolving members 12 relative to portions 32 and 34 shown in FIG. 5, it should be appreciated the gas evolving members 12 has predetermined boundaries which limit their movement. Furthermore, from the previous description given for slit 26 of the gas evolving member 12, it should be appreciated that the gas evolving members 12 are easily mounted onto the fuse element 16 after it has been wrapped about the core 14. Reference is now made to the method for which the gas evolving members 12 are mounted onto fuse element 16 and positioned at their desired locations.

In one embodiment of a method for the present invention, to obtain the desired locations for the gas evolving members 12, the slit 26 of a first gas evolving member 12 to be placed onto one or more of the fuse elements 16, is slipped over a portion of one of the fuse elements 16 that have been wound about the core 14 in a desired manner shown in FIG. 1 as being helical. The first gas evolving member 12 is then situated along the fuse element 16 in a location between the portions 32 and 34 of ribs 15. In FIG. 1 the gas evolving member 12 is shown to cover all of the width of fuse element 16 although it is only necessary that a part of the width of fuse element 16 be covered by the gas evolving members 12. The second and remaining gas evolving members 12 desired for the first fuse element 16 are then positioned onto the fuse element 16 and positioned relative to fins 15 in a manner as described for the first member 12. The gas evolving members 12 desired for the remaining wound fuse element 16 are then slipped over and positioned at the desired locations in a manner as that described for the first fuse element 16.

If desired, any or all of fuse elements 16 may be crimped to form the crimp arrangement 25, previously discussed and shown in FIG. 3, which assists in maintaining the position of the blocks of the gas evolving members 12 relative to the fuse element 16. The crimp arrangement 25 may be formed by suitable means, such as a tool having opposite members arranged in an inverted V shape, which when pressed together deform the fuse element into a crimp arrangement 25 of FIG. 3. The crimp arrangement 25 is formed before the gas evolving members 12 are slipped over the fuse element 16.

The core 14 having the one or more wound fuse elements 16 with the desired positioned and mounted gas evolving members 12, is then axially arranged within an opened casing for the high voltage current limiting fuse. A pulverulent arc quenching filler such as sand is then poured into the casing. The pulverulent arc quenching filler is caused to fill approximately all of the unoccupied space within the casing with the assistance of a suitable means such as vibrating or shaking of the casing. The filling of casing with the pulverulent arc quenching filler further restricts the position of the gas evolving members 12 within the casing. The restriction of gas evolving members 12 provides a substantially fixed position of members 12 during arcing conditions within the casing. The casing is then enclosed in such a manner as to have the terminal means disposed at each end of the casing to form the high voltage fuse.

In another embodiment of a method of the present invention, the gas evolving members 12 are mounted onto the one or more fuse elements 16 while the fuse elements 16 are being wound about core 14. The positioning of the gas evolving members 12 relative to fuse element 16 and portions 32 and 34 of core 14 is accomplished in a manner as previously described.

In the operation of a high voltage fuse, the gas evolving members 12 evolve a gas in the presence of an arc that aids in arc extinction within the casing. The gas evolving members 12 in cooperation with arc quenching pulverulent filler provides for substantial removal of the thermal energy released by an arc occurrence within the fuse housing.

It should now be appreciated that the illustrated construction of the gas evolving member 12 allows for easy mounting onto the one or more fuse elements 16. The gas evolving members 12 are adapted to evolve a gas in the presence of an arc that aids in the arc extinction. The gas evolving members 12, having limiting movement boundaries, remain relatively stationary during assembly conditions within the fuse housing.

While the invention has been particularly shown and described with reference to several preferred embodiments thereof, it will be understood by those skilled in the art that various changes in form and detail may be made therein without departing from the true spirit and scope of the invention as defined by the appended claims.

What we claim is:

1. A high voltage current limiting fuse having a generally tubular electrically insulating casing, terminal means disposed adjacent to each of the opposite ends of the said casing, and a pulverulent arc quenching filler within said casing, said high voltage current limiting fuse further comprising:

a core of cross or star-shaped transverse cross-section comprising a plurality of fins, said core axially and longitudinally extending between the opposite ends of said casing;

one or more ribbon-type fuse elements having a predetermined width and thickness, said fuse element being wound about said core;

a plurality of gas evolving members adapted to evolve a gas in the presence of an arc which aids in the extinction of the arc within said casing, said gas evolving members being mounted over a portion of at least one said fuse elements, each of said plurality of gas evolving members having a narrow slit, said slit having dimensions relative to the dimensions of said one or more fuse elements to allow the gas evolving member to be slipped over the edge of the ribbon-type fuse element and cover all or part of the width of a portion of the fuse element;

said plurality of gas evolving members being mounted onto the one or more fuse elements at predetermined locations along the core so as to arrange each of the plurality of gas evolving members between the fins of the core.

2. A high voltage current limiting fuse according to claim 1 wherein the ends of said gas evolving member are in close proximity to said fins so as to limit movement of said members along the length of the fuse elements.

3. A high voltage current limiting fuse according to claim 1 wherein said one or more ribbon-type fuse elements in the region of said gas evolving members have a crimp arrangement in their central portion of raise and abut the central portion of the fuse element against the central portion of the slit of the gas evolving member so as to intimately engage said gas evolving member.

4. A method of forming a high voltage current limiting fuse comprising the steps of:

(a) winding one ribbon-type fuse element about a core of cross or star-shaped transverse cross-sections comprising a plurality of fins;

(b) supplying a plurality of gas evolving members adapted to evolve a gas which aids in arc extinction in the presence of an arc; each of said plurality of gas evolving members having a narrow slit having dimensions to allow the gas evolving member to be slipped over the edge of a fuse element in a direction transversely of the fuse element into a position where the member spans all or part of the width of a portion of the associated fuse element;

(c) positioning said plurality of gas evolving members over said portions of said wound fusible element at predetermined locations so as to arrange each of said plurality of gas evolving members to span all or part of the width of portions of said one or more wound fuse element and to be located between the fins of said core;

(d) assembling said core having said wound one or more fuse elements and said positioned plurality of gas evolving members into a generally tubular electrically insulating casing;

(e) filling the space within said casing with a pulverulent arc quenching filler, and;

(f) enclosing said casing with said arranged elements.

5. The method of forming a high voltage current limiting fuse according to claim 4 in which additional fuse elements are wound about the core and additional gas evolving members are applied to said fuse element as set forth in claim 4.

6. A method of forming a high voltage current limiting fuse comprising the steps of:

(a) supplying a plurality of gas evolving members adapted to evolve a gas in the presence of an arc which aids in the extinction of the arc, each of said plurality of gas evolving members having a narrow slit having dimension to allow the gas evolving member to be slipped over and cover all or part of the width of a portion of a fuse element;

(b) winding the initial portion of a fuse element about a core of cross or star-shaped transverse cross-sections comprising a plurality of fins;

(c) slipping a first of said plurality of gas evolving members over a yet-to-be wound portion of the fuse element so as to arrange the first gas evolving member to span all or part of the width of portions of the fuse element located between the ribs of said core and then continuing the winding operation to locate said first member between said ribs;

(d) continuing steps (b) and (c) until the desired number of said gas evolving members are slipped over said fuse element and located between the fins of the core along the core length;

(e) assembling said core having said wound fuse element and said located plurality of gas evolving members into a generally tubular electrically insulating casing;

(f) filling the space within said casing with a pulverulent arc quenching filler, and (g) enclosing said casing.

7. The method of forming a high voltage current limiting fuse according to claim 6 in which additional fuse elements are wound about the core and additional gas evolving members are applied to said fuse element as set forth in claim 6.

* * * * *